United States Patent [19]

Giles

[11] Patent Number: 4,879,844

[45] Date of Patent: Nov. 14, 1989

[54] APPARATUS AND METHODS FOR SHARPENING POINTS

[76] Inventor: John E. Giles, 8614 Tarpon Springs Rd., Odessa, Fla. 33556

[21] Appl. No.: 73,572

[22] Filed: Jul. 15, 1987

[51] Int. Cl.[4] ..... B24B 19/16

[52] U.S. Cl. ..... 51/31; 51/33 R

[58] Field of Search ..... 51/31, 33, 35, 43, 58, 51/60, 68, 241 B, 241 A, 34 K, 57, 32, 90; 144/28.72, 28.6, 28.3, 28.7, 30

[56] References Cited

U.S. PATENT DOCUMENTS

| | | | |
|---|---|---|---|
| 1,089,456 | 3/1914 | Beam | 51/57 |
| 2,017,532 | 10/1935 | Elter et al. | 51/241 B |
| 2,054,335 | 9/1936 | Nelson | 51/90 |
| 2,105,762 | 1/1938 | Zimmerman | 51/34 K |
| 2,181,285 | 11/1939 | Schuler | 120/96 |
| 2,189,476 | 2/1940 | Siggelko | 120/96 |
| 2,991,757 | 7/1961 | Dahle | 120/96 |
| 3,037,329 | 6/1962 | Ernst et al. | 51/43 |
| 3,177,507 | 4/1965 | Becker et al. | 10/21 |
| 3,287,859 | 11/1966 | Leveque | 51/120 |
| 3,289,641 | 12/1966 | Ginsberg | 120/96 |
| 3,667,516 | 6/1972 | Grossjean | 144/28.11 |
| 3,874,123 | 4/1975 | Hopkins et al. | 51/120 |
| 4,054,164 | 10/1977 | Kose et al. | 144/28.7 |
| 4,291,502 | 9/1981 | Grimsby et al. | 51/120 |

*Primary Examiner*—Robert Rose

*Attorney, Agent, or Firm*—Charles M. Kaplan

[57] ABSTRACT

A needle sharp conical point can be quickly honed by methods and apparatus that employ reciprocating or rotating abrasive surfaces that may be revolved in a circle around the point being sharpened. A reciprocating surface may be used to hone non-conical points. The size and shape of the points may be adjusted by changing the location at which the moving abrasive surface intersects the axis of the point. Examples of hand held, portable, self energizing apparatus are disclosed.

34 Claims, 3 Drawing Sheets

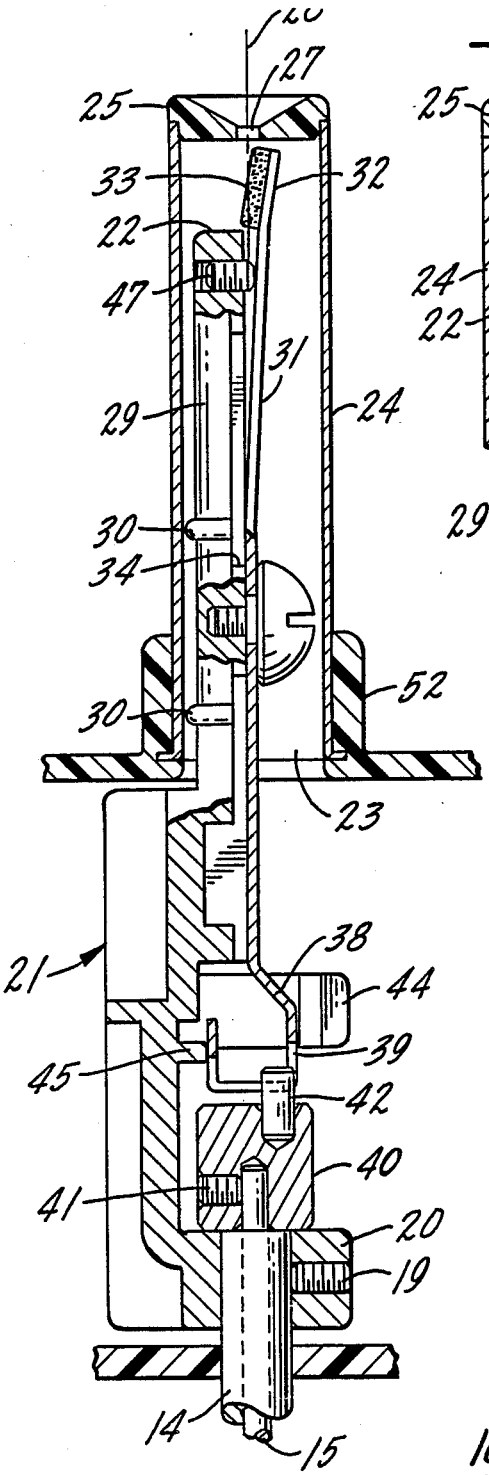
Fig.5.
Fig.6.
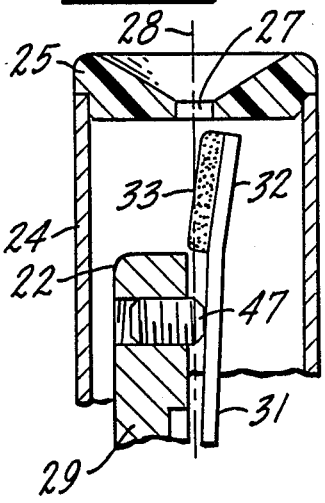
Fig.7.
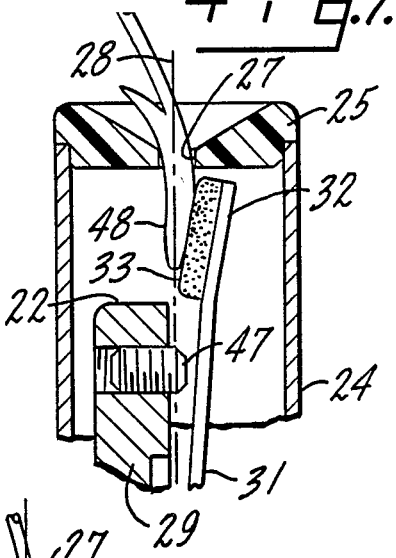
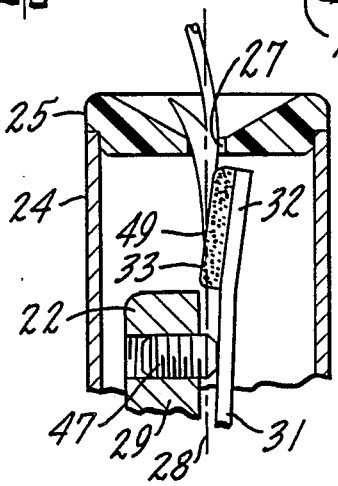
Fig.8.
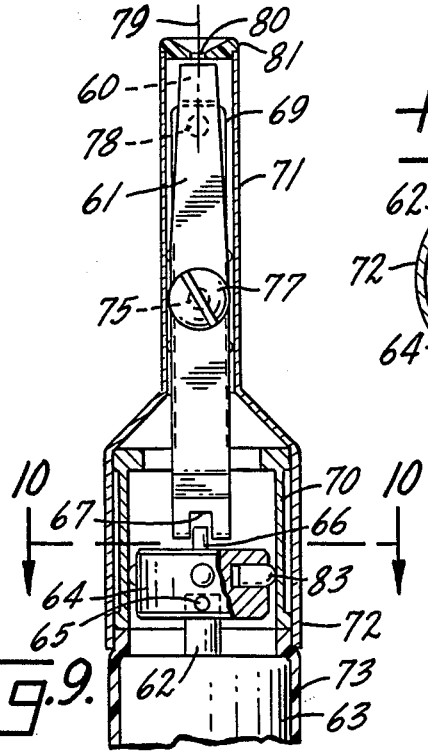
Fig.9.
Fig.10.
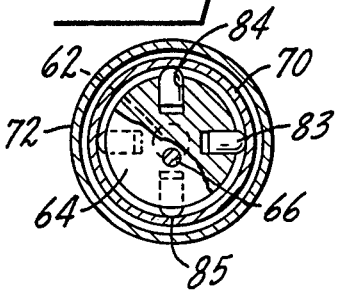

APPARATUS AND METHODS FOR SHARPENING POINTS

BACKGROUND OF THE INVENTION

This invention relates to the sharpening of pointed tools and objects such as scribers and punches, and fish hooks. Pointed tools are ordinarily given a reasonably sharp point when they are manufactured, but they usually become dull during usage and require honing to restore their sharpness. Also, skilled fishermen know that many more fish can be caught if the hooks they use have needle sharp points, but fish hooks are seldom manufactured with sufficiently sharp points.

Dull points have most often been sharpened manually with files, oilstones and grinding wheels. The points on scribers, punches and other relatively large tools can be sharpened on an electric bench grinder by spinning the tool manually against the flat side of the abrasive wheel, but great care must be taken to avoid overheating the extreme tip of the point so as to reduce its hardness. Also, the angle at which the point is held against the wheel and the speed at which it is rotated requires that the person doing the sharpening have a high degree of dexterity and experience. It is particularly difficult and time consuming to sharpen fish hooks. The shank tends to get in the way and under normal fishing conditions the light may be bad, the boat may rock, or the conditions encountered out of doors may be otherwise unfavorable for this task. The problems of honing fish hooks to a needle sharp point are compounded for treble hooks because of the difficulties in manipulating them. The result usually is that after a few tedious, time consuming, or unsuccessful efforts to get a needle sharp point,the fisherman gives up and fishes with dull hooks.

OBJECTIVES OF THIS INVENTION

Accordingly, it is an object of this invention to provide improved apparatus and methods for producing needle sharp points.

Another object is to provide a portable sharpening tool that has a self contained power source.

Another object is to provide methods and apparatus for producing needle sharp points that do not require a person to have any special skill, experience, dexterity, or training.

Another object is to provide a very fast way to sharpen points.

Another object is to produce cone shaped points of adjustable angle on metal objects.

Another object is to provide a durable, relatively small, battery powered device that will sharpen a wide variety of tools and fish hooks in a short time without overheating their points.

Another object is to provide a portable, hand held, electrically powered sharpening tool that has its working parts enshrouded so that it can be used under normal and adverse fishing conditions to sharpen a lure with multiple treble hooks having various kinds of skirting material surrounding the hooks.

Another object is to produce sharp points with simplified methods and apparatus that are accurate, easily maintained, usable by either right or left handed people, and which do not possess defects or disadvantages of the prior art.

Other objects and advantages of the invention will be found in the specification and claims, and the scope of the invention will be set forth in the claims.

DESCRIPTION OF THE DRAWINGS

FIG. 5 is an enlarged, partially cross sectional side view of the moving parts of this embodiment.

FIGS. 6–8 are enlarged partially cross sectional views of the tip of this embodiment showing the sharpening of a fish hook.

FIG. 9 is a partially cross sectional schematic plan view of another embodiment of the invention.

FIG. 10 is a cross sectional view taken along the line 10—10 in FIG. 9.

DESCRIPTION OF THE INVENTION

Figure 1:
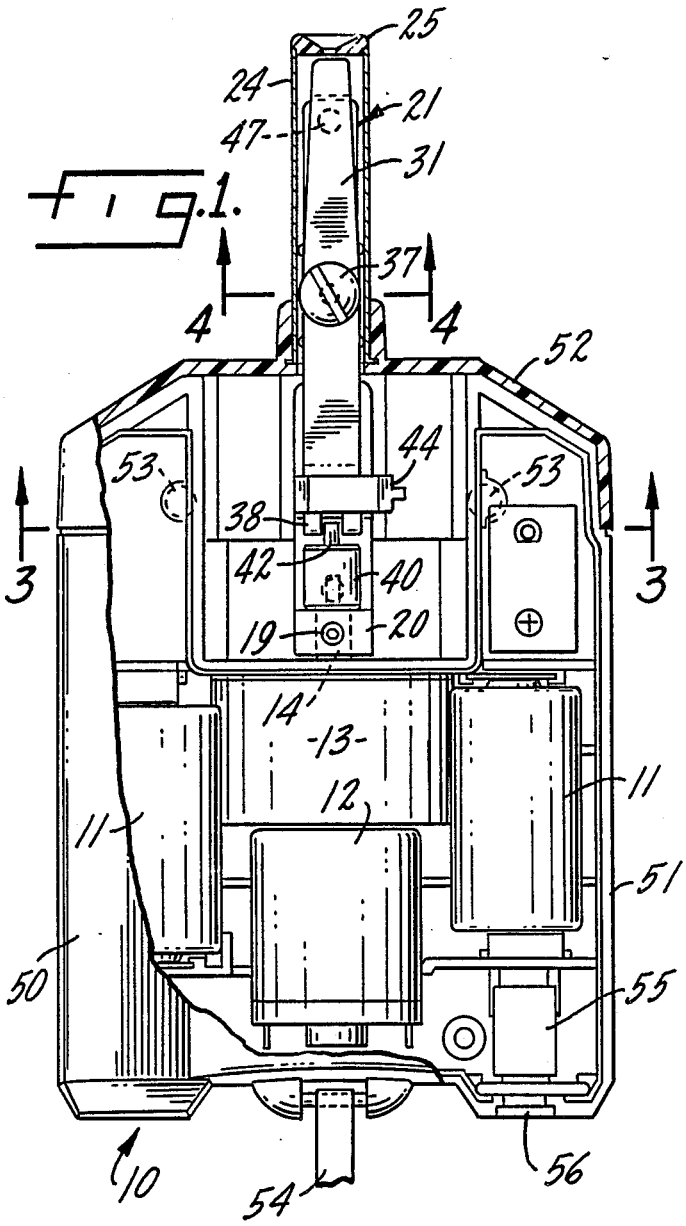
FIG. 1 is a partially broken away plan view of an embodiment of the invention.
Figure 2:
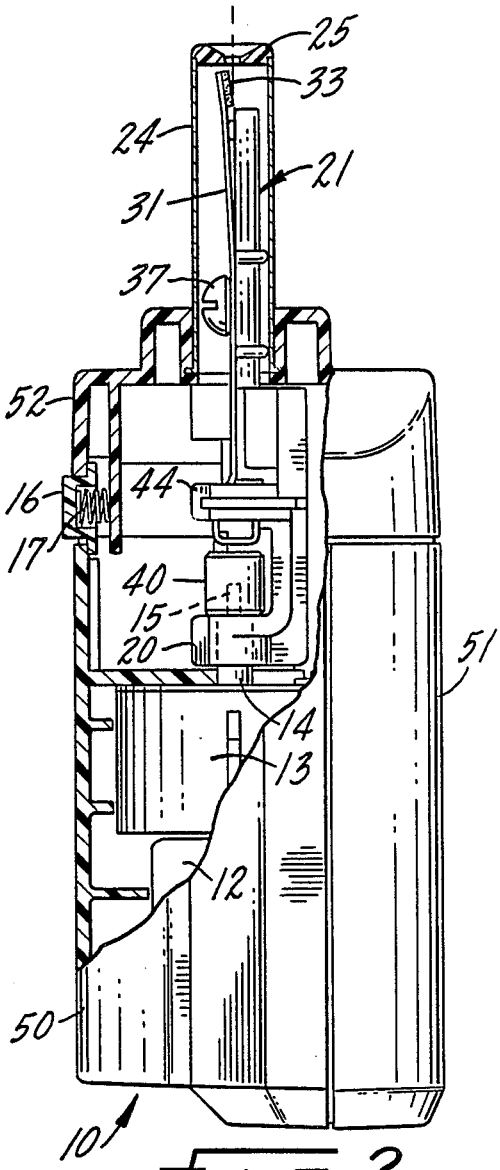
FIG. 2 is a partially broken away side view of the embodiment in FIG. 1.
Figure 3:
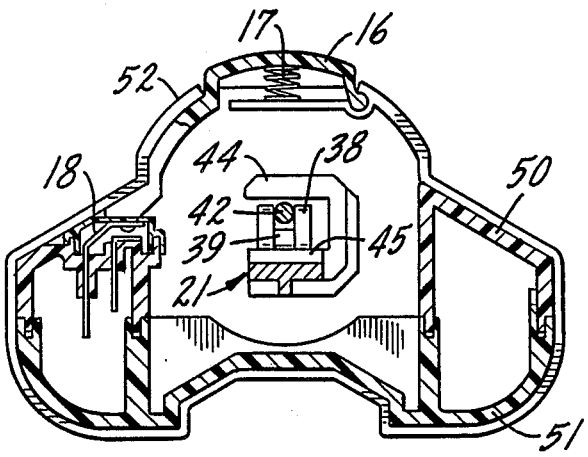
FIG. 3 is a cross sectional view taken along the line 3—3 in FIG. 1.
Figure 4:
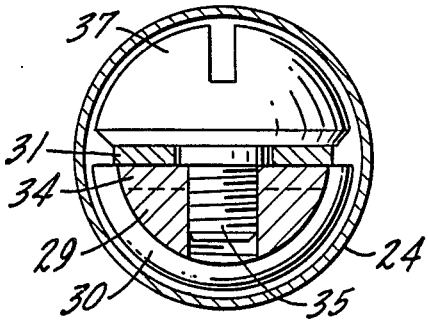
FIG. 4 is a cross sectional view taken along the line 4—4 in FIG. 1.

The drawing shows apparatus for honing needle sharp, cone shaped points on metal objects. The embodiment of FIGS. 1–8 is a portable hand held sharpener 10 that may be powered by a pair of 1.2 volt NiCad batteries 11 connected to a fractional h.p. D.C. motor 12 that makes 8,192 r.p.m. Motor 12 powers a conventional planetary gear box 13 from which emerge two coaxial shafts 14 and 15. Shaft 15 rotates at the same speed as motor 12 and may be an extension of the motor shaft, and shaft 14 rotates at a substantially slower speed than shaft 15 (e.g. 128 r.p.m. when gears 13 have a reduction ratio of 64 to 1). Motor 12 is activated by pressing a pivoted button 16 having a return spring 17 to close a switch 18 that completes the circuit connecting it to batteries 11 in conventional manner.

Shaft 14 is connected by a set screw 19 to one end 20 of a support bracket 21 for the assemblage of moving parts of this embodiment which rotates with that shaft. The other end 22 extends through the open end 23 of a cylindrical tube 24 projecting from the end cap 52 of sharpener 10. The other end of tube 24 is closed by an end surface 25 that has a center hole 27 centered on the central axis 28 of the tube, and bracket end 22 is spaced a short distance from hole 27. Bracket 21 has a relatively stiff hemi-cylindrical rod 29 that revolves freely in a circle in tube 24 and has curved bearing ridges 30 that contact the inside surface of the tube and space the rest of rod 29 from the tube. The inside of sharpener 10 is provided with appropriately located surfaces that align and support bracket 21 as it is rotated by shaft 14.

Bracket 21 supports and carries with it as it rotates, a pivoted shuttle 31. At one end 32 the shuttle has affixed to it a flat, non-loading metal honing abrasive surface or pad 33, such as ruby, diamond or cubic boron nitride, that is angled (e.g. 6 degrees) to central axis 28. Shuttle 31 is connected intermediate its ends to a circular shoulder 34 on circular rod 29 by a threaded pivot pin or stud 35 that holds the assembly together. Shoulder 34 spaces most of the shuttle away from rod 29 to reduce friction and wear. Stud 35 has an integral, slotted, hemispherical head 37 that bears against the other side of shuttle 31. The other end 38 of shuttle 31 is formed so as to define a slot 39. A rotary cylindrical cam 40 is attached at its central axis to shaft 15 by a set screw 41. An off center pin 42 on cam 40 protrudes into slot 39 and engages shuttle 31 as the cam is rotated at high speed by shaft 15. This causes both ends of shuttle 31 to reciprocate back and forth in opposite directions about stud 35, while the shuttle is carried by bracket 21 in a circular path around the central axis 28 of tube 24. A generally L-shaped guide arm 44 extends from bracket 21 into contact with one side of end 38 of the shuttle for keeping the shuttle in proper alignment, and a ridge 45 on bracket 21 guides the other side of end 38. Shuttle 31 should be made from a flexible resilient metal such as stainless steel, and a threaded nib 47 that extends at a right angle to axis 28 adjacent end 22 of rod 29 flexes or urges the shuttle slightly away from rod 29 so as to preload the shuttle and abrasive surface 33 with a slight tension.

As shown in FIGS. 6–8, when no point is being honed, shuttle 31 contacts nib 47, and flat abrasive surface 33 intersects central axis 28 at a predetermined location determined by the extent to which nib 47 protrudes from rod 29. The entrance of hole 27 may be conically shaped to facilitate entry of a point 48, but the plane of hole 27 is considered to be the flat horizontal edge of end surface 25. When a dull point 48 is inserted through hole 27, it contacts abrasive surface 33 and flexes shuttle 31 to a greater degree, thus moving the shuttle out of contact with nib 47, as shown in FIG. 7. After dull point 48 has been inserted as far as it will go through hole 27, the axis of the dull point will approximately coincide with axis 28. When button 16 is pushed and motor 12 is energized, rotation of shaft 15 will cause flat abrasive surface 33 to reciprocate at a high speed against dull point 48, and rotation of shaft 14 will cause abrasive surface 33 to be carried in a complete circle around point 48 at a slower speed. This will quickly hone away metal until a needle sharp conical point 49 is produced, as shown in FIG. 8, when the resiliency of the metal of shuttle 31 has moved it back toward or into contact with nib 47. In most cases it is not necessary for shuttle 31 to move all the way back into contact with nib 47 to hone a sharp point.

The location at which axis 28 contacts abrasive surface 33 can be varied, and hence the size and angle of conical point 49 can be adjusted, by threading nib 47 through rod 29 so that the extent to which the nib projects beyond the rod can be varied. The ability to vary the extent to which the nib 47 projects also permits the bending of shuttle 31 to change the angle at which abrasive surface 33 intersects axis 28, and thus to adjust the point produced by the sharpener. The action of nib 47 flexes shuttle 31 and thus preloads surface 33 by exerting a force on the shuttle at essentially a right angle to central axis 28. Instead of using a threaded nib 47, nib 47 may be held by friction in a hole in rod 29 so that nibs of different lengths may be inserted and removed to adjust the spacing between shuttle 31 and rod 29.

The working parts of sharpener 10 may be contained in a three piece plastic housing having a pair of side pieces 50 and 51, and a top cap 52 that nest with each other and are secured in place by appropriately placed screws 53 in conventional manner. Suitable gaskets should be provided, and a wrist strap 54 may be hung on the outside. A conventional recharging jack 55, protected by a removable cover 56, should be connected into the electric circuit of sharpener 10 for recharging the batteries 11.

FIGS. 9 and 10 show another embodiment of the invention that is the same as the embodiment of FIGS. 1–8 in that an abrasive pad or surface 60 on one end of a pivoted shuttle 61 reciprocates as it is revolved in a circle around a point being sharpened. This embodiment differs from the embodiment of FIGS. 1–8 in that only one shaft 62 is driven by motor 63, and no gear box is needed. Shaft 62 turns at the relatively high speed of motor 63 and is connected to a revolving cam 64 by a set screw 65. An off center knob 66 on the cam enters a slot 67 at the other end of shuttle 61. A hemi-cylindrical rod 69 extends from a hollow support bracket 70 into a tube 71 on a removable end cap 72 of the housing 73. Bracket 70 is free to rotate in housing 73 and end cap 72. Shuttle 61 is connected to rod 69 by a threaded pivot pin or stud 75. An integral slotted hemispherical head 77 of stud 75 bears against the other side of shuttle 61 for supporting the shuttle and holding the asseembly together. As described with reference to FIGS. 6–8 nib 78 is threaded through rod 69 and protrudes from the rod so as to flex shuttle 61 and position abrasive surface 60 with respect to the central axis 79 of the center hole 80 of an end surface 81 that closes tube 71. Rotation of the single driven shaft 62 turns cam 64 and knob 66 and thus causes shuttle 61 to pivot about pin 75 and abrasive surface 60 to reciprocate at a high speed in the manner described previously with respect to FIGS. 1–8. In this embodiment slip clutch means, such as several sliding weights 83, is used to rotate support bracket 70 at a slower speed than shaft 63. Weights 83 are received in holes 84 that are symetrically located in cam 64. As shaft 62 rotates cam 64 at a high speed, centrifugal force slides the weights 83 away from the shaft until their ends 85 contact the inside surface of hollow support bracket 70. The sliding frictional engagement of ends 85 against the inside of bracket 70 drags the bracket and causes it to rotate at a much slower speed than cam 64 is rotating; this carries the reciprocating abrasive surface 60 in a complete circle around a point inserted through hole 80 and hones a needle sharp conical point on it.

Figure 11:
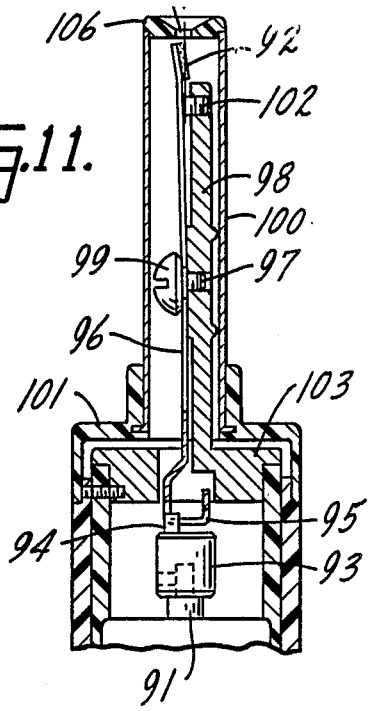
FIG. 11 is a schematic cross sectional view of another embodiment of the invention.
Figure 12:
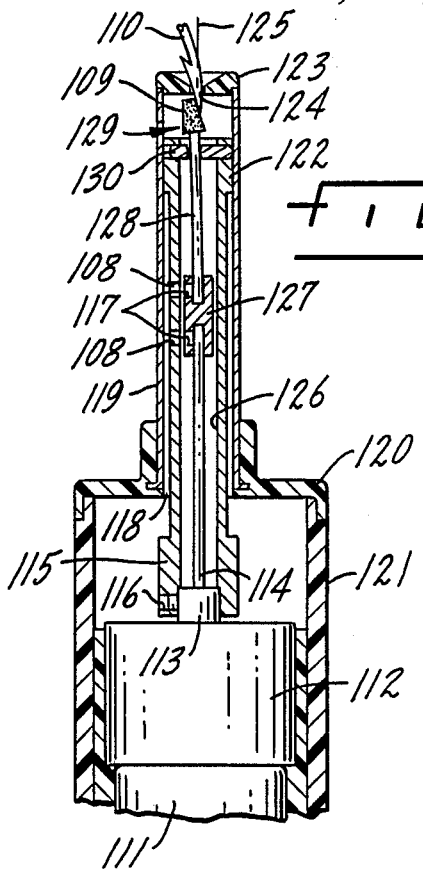
FIG. 12 is a schematic cross sectional plan view of another embodiment of the invention.
Figure 13:
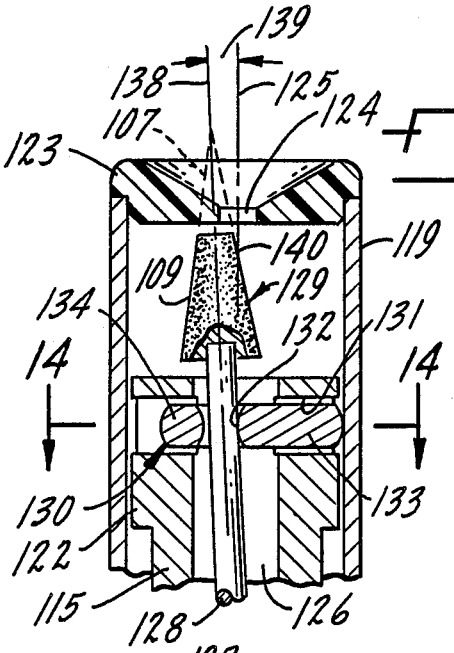
FIG. 13 is an enlarged cross sectional view of the tip of the embodiment of FIG. 12.

FIG. 11 shows another embodiment that requires only one motor driven shaft 91 to reciprocate abrasive surface 92, but in this embodiment the reciprocating surface does not rotate around a point being sharpened. Motor driven shaft 91 turns a cam 93 at a relatively high speed, and an off center knob 94 is received in a slot 95 at one end of a shuttle 96 that pivots about a threaded pin or stud 97. Shuttle 96 is positioned and supported by a hemi-cylindrical rod 98 that extends from a stationary support 103. An integral, slotted hemispherical head 99 of stud 97 holds the assembly together inside of a cylindrical tube 100 that extends from a removable end cap 101. A nib 102 threaded through block 98 extends beyond the block into contact with shuttle 96. Nib 102 positions and adjusts the abrasive surface 92 on the other end of the shuttle with respect to the central axis 104 of center hole 105 in end surface 106 in the same manner described with reference to FIGS. 6–8. Rotation of shaft 91 turns cam 93, which causes shuttle 96 to pivot rapidly about pin 97 and reciprocates surface 92 adjacent hole 105. A point being sharpened by insertion through hole 105 should be manually rotated if a conical point is needed. If a many sided flat surfaced point is needed, the point should be inserted into hole 105, withdrawn when honed as much as will occur from that position of surface 92, turned and inserted again into hole 105. This procedure should be repeated until the point is sharpened to the specific shape required.

FIGS. 12–16 show other embodiments in which a circular abrasive surface 109 rotates, rather than reciprocates, as it is moved in a circle around a point 110 being sharpened. A conventional D.C. motor 111 controlled by a switch and energized by rechargable NiCad batteries, as previously described, has a shaft that powers a conventional gear box 112. A pair of coaxial shafts 113 and 114 extend from the gear box, with shaft 113 rotating at a relatively slow speed and shaft 114 rotating at a high speed. Shaft 113 is connected to one end of a hollow cylindrical support bracket 115 by a set screw 116. Bracket 115 extends into the open end 118 of a cylindrical tube 119 that projects from a removable end cap 120 on the sharpener housing 121, and has a circular bearing end collar 122 that centers the bracket in tube 119. An end surface 123 closes the other end of tube 119 and has a center hole 124 with a central axis 125 that coincides with the central axis of tube 119. Shaft 114, which may be an extension of the shaft of motor 111, passes through and rotates independently of shaft 113. Shaft 114 extends into the relatively large center passage 126 of bracket 115 where it is connected by a sleeve 127 to the shaft 128 of a honing burr 129. The truncated conical abrasive surface 109 of the burr defines an apex angle 107 of about twelve to fourteen degrees. Sleeve 127 couples burr 129 to shaft 114 so that the burr rotates at the same speed as shaft 114, but set screws 117 in the sleeve enable burr 129 to be removed and replaced when dull or when a different shaped point is needed. Holes 108 through bracket 115 provide access to set screws 117.

A square bearing 130 slides freely in a square channel 131 that passes through collar 122. Shaft 128 is guided by a relatively small off center bore 132 in bearing 130 that lines up with the larger passage 126 in bracket 115. Making bearing 130 and its channel 131 square in cross section prevents the bearing from twisting. One side 133 of bearing 130 is a predetermined distance longer than the other side 134 so that the terminal end 135 of side 134 will be in channel 131 out of contact with the inside surface of tube 119 when the terminal end 136 of side 133, is in contact with the inside of the tube. The length of side 133 is predetermined so that the central axis 138 of conical surface 109 is offset a predetermined distance 139 from central axis 125, which is tangent to surface 109 at 140; this also flexes shaft 128 slightly. It is intended that axes 125 and 138 be essentially parallel, but at times during the honing operation they may be only approximately parallel because of the flexing of shaft 128, and such flexing of shaft 128 will pre-load surface 109 for honing, as explained with reference to FIGS. 6–8.

Figure 15:
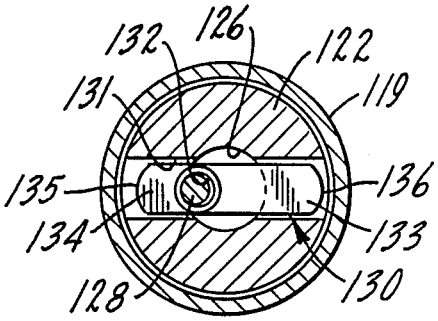
FIG. 15 is a cross sectional view corresponding to FIG. 14 showing the bearing in a deflected position.
Figure 14:
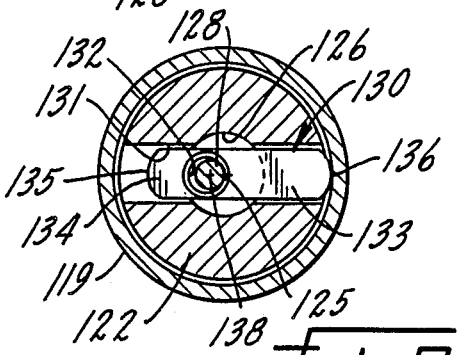
FIG. 14 is a cross sectional view taken along the line 14—14 in FIG. 13.

After motor 111 is energized, shaft 114 will rotate burr 129 at a high speed and shaft 113 will rotate bracket 115 at a slower speed. As bracket 115 rotates, the off center bore 132 in bearing 130 will move burr 129 in a circle around the central axis 125 of tube 119. When a point being sharpened is inserted through center hole 124, essentially the same action takes place as is illustrated in FIGS. 6–8 in that the dull point will contact the angled surface 109 of burr 129 and push the burr toward the inside surface of tube 119 by flexing shaft 128 as the center line of the dull point essentially coincides with center axis 125. Since bearing 130 is free to slide in channel 131 and since its end 135 terminates short of tube 119, end 135 can slide toward the tube innerwall as shaft 128 is flexed. This will move end 136 out of contact with tube 119, as shown in FIG. 15, and put as additional load on honing surface 109 as a result of the additional flexing of shaft 128. The forces resulting from flexing of shaft 128 will urge surface 109 back toward or to its original position where bearing end 136 is in contact with tube 119. This movement enables burr 129 to hone a needle sharp conical point on the dull point being sharpened even if bearing end 136 does not move all the way back into contact with tube 119. By changing the location of bore 132 in bearing 130 or by placing additional spaced bores 132 in bearing 130, the amount of metal that can be removed from the point being sharpened can be adjusted because such a change in location of bore 132 will change the location on abrasive surface 109 at which it is intersected by central axis 125. Changing the location of bore 132 may also be needed if the size or shape of burr 129 is changed. Such a change in the location of the intersection between surface 109 and axis 125 would result from the force of bearing 130 acting at essentially right angles to axis 125.

Figure 16:
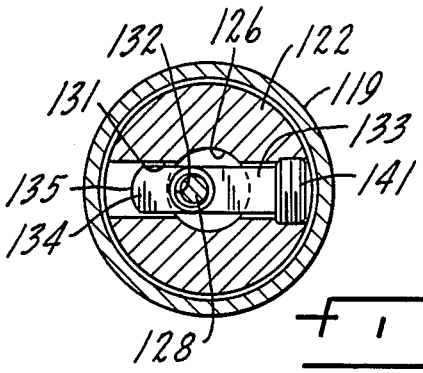
FIG. 16 is a cross sectional view corresponding to FIG. 14 showing another embodiment of the invention.

FIG. 16 shows another embodiment in which a set screw 141 has been threaded into a tapped hole at one end of channel 131, and end 133 has been shortened to accomodate the set screw. Advancing or retracting screw 141 changes the position of bore 132 and hence the location of abrasive surface 109 for the purposes described above. In other respects this embodiment is identical to that shown in FIGS. 12–15.

The invention also includes methods of honing. In one method a dull metal point 48 is positioned in a predetermined location by center hole 27 in surface 25 with the central axis of the point being essentially coincident with the central axis 28 of the hole. Point 48 is moved into contact with a flat abrasive surface 33 and then held stationary. Abrasive surface 33 is reciprocated by the action of shuttle 31 while it is in contact with point 48. The reciprocating surface 33 is moved in a complete circle around point 48 by the action of shaft 14 on bracket 21. The nib 47 flexes shuttle 31 and thus urges abrasive surface 33 against point 48 under flexed metal tension. The distance nib 47 protrudes from rod 29 controls the maximum amount of metal that can be removed from point 48.

In another method, a dull point such as 48 would be positioned with its central axis in a predetermined location, such as essentially coincident with axis 125, and then moved into contact with conical abrasive surface 109 and held stationary, so that its central axis is approximately parallel with axis 138 of the conical surface. Conical surface 109 is then rotated around its central axis 138 while the central axis 138 is rotated in a complete circle around the central axis 125 of the metal point. The action of bearing 130 flexes shaft 128 and this urges conical abrasive surface 109 against the dull metal point under flexed metal tension. By keeping axes 125 and 138 generally parallel, the size of the apparatus used to carry out the method is reduced and such apparatus is greatly simplified.

In another method, a conical point is honed by moving an abrasive surface 33 or 109, mounted on a flexible support 31 or 128, against a metal point. The metal point is held in place in a hole 27 or 124 while the moving surface 33 or 109 is rotated completely around the metal point. The metal point creates tension against the abrasive surface 33 or 109 by flexing the shaft 31 or 128. The amount of metal removed from the point can be adjusted by changing the location at which the surface 33 or 109 intersects the central axis 28 or 125 of the hole in which the point is held, and this can be accomplished by using nib 47 or bearing 130 to exert a force on flexible support 31 or 128 at essentially a right angle to central axis 28 or 125.

It has thus been shown that by the practice of this invention needle sharp points can be quickly honed on a metal implement without requiring the person doing the honing to have any special skills or experience. The devices disclosed are portable and can be used out of doors, and they operate automatically. All moving parts are enclosed, which protects the parts from adverse outdoor conditions and protects the user from harm from contact with the parts. Treble fish hooks can be honed quickly without subjecting the person doing the sharpening to the danger of being impaled on one of the hooks.

While the present invention has been described with reference to a particular embodiment, it is not intended to illustrate or describe herein all of the equivalent forms or ramifications thereof. For example, batteries that are not rechargable could be used, or a separate motor could be used to power each of the shafts in the two shaft embodiments, or a wind-up spring motor could be used instead of an electric motor. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. Apparatus for sharpening a metal point comprising:

A. means for positioning said metal point in a predetermined location;

B. an abrasive surface for contacting said metal point:

C. means for reciprocating said abrasive surface while it is in contact with said metal point comprising first rotary means rotating at a predetermined speed; and D. means for moving said abrasive surface around said metal point while said abrasive surface is reciprocating in contact with said metal point including second rotary means rotating at a slower speed than said first rotary means.

2. The invention defined in claim 1, wherein said first and second rotary means comprise separate shafts turned at different speeds by motor means.

3. The invention defined in claim 2, wherein said separate shafts are coaxial.

4. The invention defined in claim 1, wherein said first and second rotary means both obtain their power from a single motor driven shaft.

5. The invention defined in claim 4, wherein said first rotary means is driven directly by said shaft.

6. The invention defined in claim 5, wherein said first and second rotary means are coupled by slip clutch means.

7. The invention defined in claim 6, wherein said first and second rotary means are coupled by friction clutch means.

8. The invention defined in claim 7, wherein said friction clutch means comprises movable weights housed in slots in said first rotary means, and said weights being moved into sliding frictional contact with said second rotary means by centrifugal force as said first rotary means is turned by said shaft.

9. Apparatus for sharpening a metal point comprising:

a tube having an open end and a opposite end that is closed except for a small hole having its central axis at said opposite end, a flexible support pivoted intermediate the ends of said tube and having a first end adjacent said hole, said first end having an abrasive surface in a plane that intersects said central axis, a second end of said pivoted member having a slot therein, means rotating a cam member around a predetermined axis, a projection on said cam member that is offset from its axis of rotation, said projection extending into said slot so as to move said second end back and forth as said member rotates, whereby said abrasive surface reciprocates across said central axis.

10. The invention defined in claim 9, further comprising means for adjusting the position of said abrasive surface with respect to said central axis.

11. The invention defined in claim 10, wherein said adjusting means comprises a threaded member having a terminal end bearing against said flexible support between said pivot axis and said first end.

12. The invention defined in claim 11, wherein said threaded member moves on an axis that is essentially ninety degrees to said central axis.

13. The invention defined in claim 11, further comprising means for rotating said abrasive surface in a circle around said central axis while said abrasive surface is reciprocating.

14. The invention defined in claim 11, wherein said means rotating a cam member comprises in D.C. electric motor powered by a rechargable battery.

15. Apparatus for sharpening a metal point comprising:

A. means for positioning said metal point in a predetermined location;

B. an abrasive surface for contacting said metal point;

C. means for reciprocating said abrasive surface while it is in contact with said metal point comprising a flexible metal support having said abrasive surface adjacent one of its ends, and a pivot axis intermediate its ends; and D. means for moving said abrasive surface around said metal point while said abrasive surface is reciprocating in contact with said metal point.

16. And the invention defined in claim 15, further comprising means between said one end and said pivot axis for adjusting the position of said abrasive surface with respect to said metal point.

17. The invention defined in claim 15, wherein said means for positioning said metal point comprises a tube having a surface closing one of its ends, and a hole centered in said surface so that upon insertion of said point into said hole, said point engages said abrasive surface and flexes said metal support slightly so as to urge said abrasive surface against said metal point.

18. Apparatus for sharpening a metal point comprising:

A. means for positioning said metal point in a predetermined location;

B. an abrasive surface for contacting said metal point;

C. means for reciprocating said abrasive surface while it is in contact with said metal point comprising pivoted means having said abrasive surface attached adjacent one of its ends, said pivoted means being connected to and pivoted by first rotating means adjacent its other end; and D. means for moving said abrasive surface around said metal point while said abrasive surface is reciprocating in contact with said metal point.

19. The invention defined in claim 18, further comprising a slot in said other end of said pivoted means and crank means extending from said first rotating means into said slot.

20. The invention defined in claim 19, wherein said means for positioning said metal point comprises a surface having a hole therethrough, said hole being located in a predetermined plane, and said plane of said hole being essentially parallel to the plane of said slot.

21. The invention defined in claim 20, wherein said means for moving said abrasive surface around said metal point comprises second rotating means that rotates at a slower speed than said first rotating means.

22. The invention defined in claim 20, wherein said positioning means locates said metal point along a predetermined axis and said abrasive means intersects said axis at an angle which produces a conical point.

23. Apparatus for sharpening a metal point comprising:

A. means for positioning said metal point in a predetermined location;

B. an abrasive surface for contacting said metal point;

C. means for reciprocating said abrasive surface while it is in contact with said metal point comprising a flexible metal support having said abrasive surface adjacent one of its ends; and D. means for moving said abrasive surface around said metal point while said abrasive surface is reciprocating in contact with said metal point.

24. Apparatus for sharpening a metal point comprising:

A. means for positioning said metal point in a predetermined location comprising a tube having an open end and an opposite end that is closed except for a small hole therethrough for receiving said metal point;

B. an abrasive surface for contacting said metal point;

C. means for reciprocating said abrasive surface while it is in contact with said metal point; and D. means for moving said abrasive surface around said metal point while said abrasive surface is reciprocating in contact with said metal point.

25. The invention defined in claim 24, wherein said small hole is centered on the central axis of said tube.

26. Apparatus for sharpening a metal point comprising:

A. means for positioning said metal point in a predetermined location;

B. an abrasive surface for contacting said metal point;

C. means for reciprocating said abrasive surface while it is in contact with said metal point;

D. means for moving said abrasive surface around said metal point while said abrasive surface is reciprocating in contact with said metal point; and E. means for adjusting the position of said abrasive surface with respect to said metal point.

27. The invention defined in claim 26, wherein said adjusting means is threaded.

28. Apparatus for sharpening a metal point comprising:

A. means for positioning said metal point with its central axis in a predetermined location;

B. an abrasive surface for contacting said metal point; and

C. means for reciprocating said abrasive surface about another axis that intersects said central axis of said metal point while said abrasive surface is in contact with said metal point.

29. The invention defined in claim 28, wherein the axis along which said means for reciprocating said abrasive surface moves is transverse to said central axis of said metal point.

30. The invention defined in claim 28, wherein the axis of reciprocation of said abrasive surface is generally perpendicular to said central axis of said point.

31. The invention defined in claim 30, wherein said means for reciprocating abrasive surface pivots about the axis of reciprocation.

32. The invention defined in claim 28, wherein said means for reciprocating said abrasive surface pivots about the axis of reciprocation.

33. The invention defined in claim 28, further comprising means for moving said abrasive surface around said metal point while said abrasive surface is reciprocating in contact with said metal point.

34. The invention defined in claim 28, further comprising means for adjusting the position of said abrasive surface with respect to said central axis.

* * * * *

UNITED STATES PATENT AND TRADEMARK OFFICE

CERTIFICATE OF CORRECTION

PATENT NO. : 4,879,844

DATED : Nov. 14, 1989

INVENTOR(S) : John E. Giles

It is certified that error appears in the above-identified patent and that said Letters Patent is hereby corrected as shown below:

In column 5, line 21, "high" should be --higher--.

In column 6, line 12, the first occurrence of "as" should be --an--.

In column 8, line 41, "in" should be --a--.

Signed and Sealed this

Second Day of October, 1990

*Attest:*

HARRY F. MANBECK, JR.

*Attesting Officer*

*Commissioner of Patents and Trademarks*